US007994427B2

(12) United States Patent
Berglund et al.

(10) Patent No.: US 7,994,427 B2
(45) Date of Patent: Aug. 9, 2011

(54) HIGH VOLTAGE INSULATION SYSTEM AND A METHOD OF MANUFACTURING SAME

(75) Inventors: Mats Berglund, Borlägne (SE); Lars-Åke Svensson, Ludvika (SE); Tony Polander, Söderbärke (SE); Gunnar Jorendal, Ludvika (SE); Erik Forsberg, Smedjebacken (SE); Lars-Erik Vennerberg, Ludvika (SE)

(73) Assignee: ABB Technology Ltd., Zürich (CH)

( * ) Notice: Subject to any disclaimer, the term of this patent is extended or adjusted under 35 U.S.C. 154(b) by 0 days.

(21) Appl. No.: 12/294,373

(22) PCT Filed: Mar. 24, 2007

(86) PCT No.: PCT/SE2007/050181

§ 371 (c)(1),
(2), (4) Date: Sep. 24, 2008

(87) PCT Pub. No.: WO2007/111564

PCT Pub. Date: Oct. 4, 2007

(65) Prior Publication Data

US 2009/0108973 A1 Apr. 30, 2009

(30) Foreign Application Priority Data

Mar. 24, 2006 (SE) ..... 0600673

(51) Int. Cl.

| | |
|---|---|
| ***H01B 17/26*** | (2006.01) |
| ***H01B 17/36*** | (2006.01) |
| ***H01B 17/28*** | (2006.01) |
| ***H01F 27/02*** | (2006.01) |
| ***H01F 7/06*** | (2006.01) |

(52) U.S. Cl. ..... 174/142; 174/30; 174/143; 336/94; 29/602.1

(58) Field of Classification Search ..... None
See application file for complete search history.

(56) References Cited

U.S. PATENT DOCUMENTS 3,228,715 A * 1/1966 Neilon et al. ..... 285/313
(Continued)

FOREIGN PATENT DOCUMENTS

EP 0285895 A1 10/1988
(Continued)

OTHER PUBLICATIONS

PCT/ISA/210—International Search Report—Jun. 18, 2007.
(Continued)

*Primary Examiner* — Anh T Mai
*Assistant Examiner* — Mangtin Lian
(74) *Attorney, Agent, or Firm* — Venable LLP; Eric J. Franklin

(57) ABSTRACT

A high voltage insulation system for high-voltage direct current including a bushing, a conductor, a transformer conductor, and a connection between the conductor and the transformer conductor. A conductive shielding electrode shields the connection between the bushing and transformer. A surrounding insulation system is immersed in transformer oil. The surrounding insulation system includes transformer insulation material and bushing insulation material. A cylindrical solid insulation barrier encloses the connection between the bushing conductor and transformer conductor. At least one solid insulation barrier is fastened on the outer side of the shielding electrode. The at least one solid insulation barrier extends in an axial direction outside the axial direction of the shielding electrode and forms a distance to the insulation material of the bushing and the insulation material of the transformer, whereby a moderate voltage drop over the solid insulation barrier is obtained.

7 Claims, 1 Drawing Sheet

U.S. PATENT DOCUMENTS

| | | | | |
|---|---|---|---|---|
| 3,539,702 | A * | 11/1970 | Powell et al. | 174/9 R |
| 4,426,547 | A * | 1/1984 | Ogino | 174/31 R |
| 4,431,859 | A * | 2/1984 | Kishida | 174/31 R |
| 5,774,035 | A * | 6/1998 | Lee | 336/173 |
| 6,218,627 | B1 * | 4/2001 | Shindo et al. | 174/167 |
| 6,951,987 | B1 * | 10/2005 | Hansen et al. | 174/142 |
| 2007/0000680 | A1 * | 1/2007 | Adachi et al. | 174/73.1 |

FOREIGN PATENT DOCUMENTS

| | | | |
|---|---|---|---|
| EP | 0285895 | A1 * | 10/1988 |
| EP | 0795877 | A2 | 9/1997 |
| EP | 0795877 | A2 * | 9/1997 |

OTHER PUBLICATIONS

PCT/ISA/237—Written Opinion of the International Searching Authority—Jun. 18, 2007.

* cited by examiner

HIGH VOLTAGE INSULATION SYSTEM AND A METHOD OF MANUFACTURING SAME

CROSS-REFERENCE TO RELATED APPLICATIONS

This application claims priority to Swedish patent application 0600673-8 filed 24 Mar. 2006 and is the national phase under 35 U.S.C. §371 of PCT/SE2007/050181 filed 24 Mar. 2006.

TECHNICAL FIELD

The present invention concerns a high voltage insulation system for high-voltage direct current, comprising a bushing with a conductor, a connection to a transformer conductor, a conductive shielding electrode shielding the connection between the bushing and transformer and a surrounding insulation system immersed in transformer oil, The invention also refers to a method of manufacture a high voltage system.

BACKGROUND ART

The current connection between transformer bushing and transformer/reactor in an HVDC (High Voltage Direct Current) converter transformer or smoothing reactor is usually protected by an insulation system.

A high voltage insulation system for bushing connections of HVDC transformers and smoothing reactors is for example known from the European Patent No. 0285895. The patent discloses a bushing with its conductor connected to the transformer conductor inside a screen (a shielding electrode). The current connection inside the shielding electrode is enclosed by solid insulation barriers situated in the transformer oil, which makes up the enclosing insulation system.

The method of increasing electrical withstand strength against AC stress in transformer oil by subdividing the oil volume around an electrode is also well known.

According to a first aspect the present invention seeks to provide an improved insulation system for very high voltages. According to a second aspect the invention seeks to provide an improved method of manufacturing such a system.

SUMMARY OF THE INVENTION

These and other objectives have, according to the first aspect or the invention, been achieved by an insulation system.

An objective according to the second aspect of the invention has been achieved by a method of manufacture a high voltage insulation system.

The present invention thus relates to a design of an insulation system for bushing connections in HVDC converter transformer and smoothing reactors, which combines two insulation structures, one cylindrical barrier enclosing the bushing, the transformer side and the bushing connection shielding electrode and a barrier system fastened in the shielding electrode itself.

Further, the invention relates to a method to manufacture an insulation system.

DETAILED DESCRIPTION OF THE INVENTION

Figure 1:
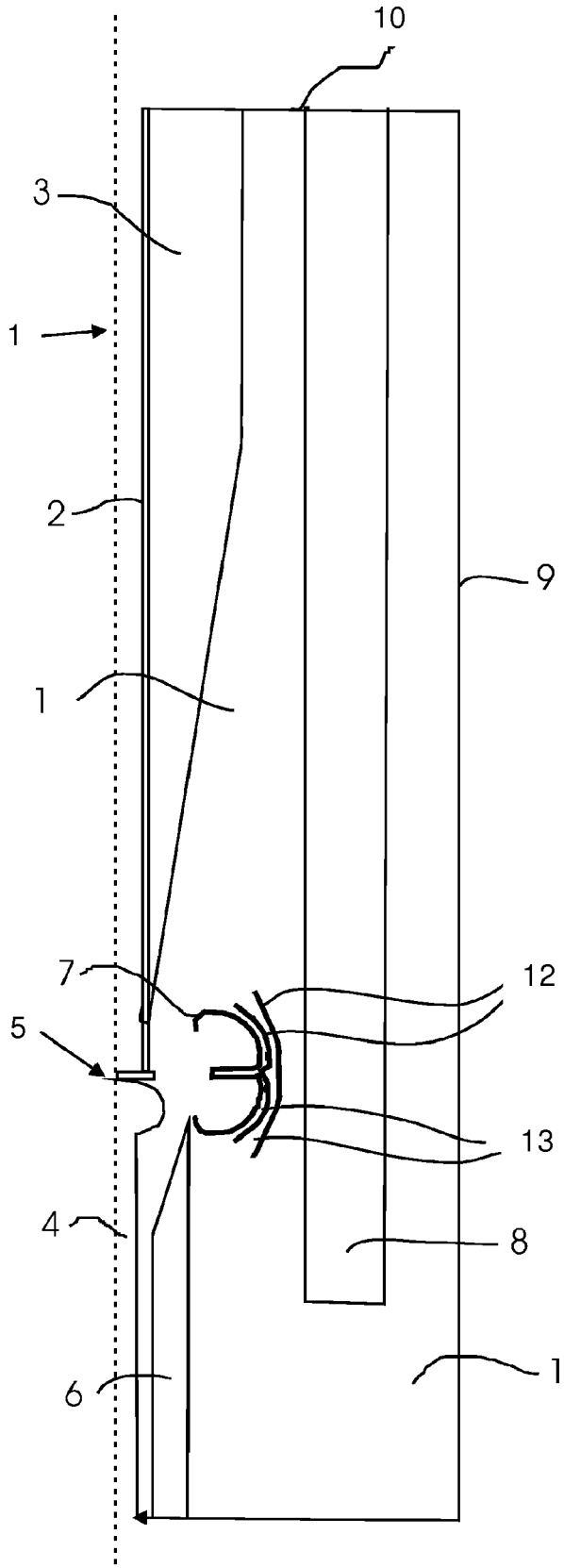
FIG. 1 shows the schematic design of the insulation system according to the invention.

The invention is, by way of example, described in the following with reference to the attached drawing, where 1 is a bushing with a conductor 2 and a bushing insulation 3. The conductor 2 connects to a transformer conductor 4 at a connection 5. Transformer insulation 6 is arranged outside the transformer conductor 4. A conductive shielding electrode 7 is shielding the connection 5. The entire bushing connection is enclosed with a cylindrical solid insulation barrier 8, which encloses the bushing 1, the shielding electrode 7 and some of the transformer side insulation material 6. 9 is a grounded turret wall and 10 is a grounded bushing flange. The insulation system is transformer immersed in transformer oil 11 or dielectric fluid with similar properties.

The bushing 1 connects to the transformer inside the shielding electrode 7. In accordance with the invention, the shielding electrode is provided with a barrier system fastened on it, which consists of solid insulation barriers 12. As illustrated in the drawing, the solid insulation barriers 12 are arranged radially outwards from the shielding electrode 7 with a distance 13 in between each barrier 12.

According to an embodiment, the solid insulation barriers 12 extend in an axial direction outside the axial direction of the shielding electrode 7 and the insulation barrier 12 closest to the shielding electrode has an axial extension which is shorter that the adjacent insulation barrier 12.

The solid insulation barriers 12 fastened on the shielding electrode end at a substantial distance 75 mm-200 mm, typically 80 mm, from the insulation material 3 of the bushing and insulation material 6 of the transformer, and are thus not in direct contact with solid insulation material on either side.

According to the invention, the barriers 12 fastened on the shielding electrode have the task to subdivide the oil volume close to the shielding electrode 7 into smaller oil volumes, which have a higher dielectric strength against AC stress than larger volumes of oil.

During DC stress, which arises due to the HVDC operation, the barriers 12 are subjected to DC stress themselves, the amplitude of which is determined by how much the barriers constrain the leakage current from ground to high voltage in every direction.

Ground 10 is situated at the bushing flange and the turret wall 9, which means that currents to ground flow axially along the bushing and transformer side, as well as in radial direction through the solid insulation barrier system 12.

In the direction tangential to the bushing and transformer side, the barriers 12 are not constraining the current flow, which allows for a very small amplification of the stress in those directions, compared to the stress obtained if they were absent.

In the direction perpendicular to that, radial direction outwards, the concentration of voltage stress due to restrictions of the current flow induced by the barriers 12 on the shielding electrode 7 and the cylindrical barrier 8 are divided between the cylindrical barrier 8 and the shielding electrode barriers 7, which makes up a reasonable voltage stress on average in the solid insulation material.

The insulation system with design in accordance with the invention as described above therefore can combine a high AC-withstand strength close to the shielding electrode 7 with a rational handling of the DC stress by the cylindrical barrier 8.

The dimension of the cylindrical barrier 8 is depending on the DC voltage level, but is always enclosing the complete length of the bushing and has an overlap of several hundreds of millimetres with the transformer side, the length of which is determined by the DC voltage stress. The barrier 8 is made from solid insulation and oil, typically being the combination of oil ducts and solid pressboard.

The solid insulation barriers 12 fastened on the shielding electrode subdivide oil volumes that have an extension of 2 mm-30 mm, preferably 3 mm-20 mm per duct, and where the number of ducts 13 may vary from one to several, typically being two or three. In the embodiment shown in the drawing, the number of barriers is two, forming two ducts 13. The barriers 12 subdividing the oil around the shielding electrode are made of solid insulation, typically pressboard, with a thickness between 1 mm and 5 mm, typically being 3 mm thick.

One advantage of using the cylindrical barrier 8 is that the production of it is independent of the production of transformer side insulation material 6 and therefore can be handled in parallel to the production of the transformer itself. It also provides easy assembly in the production process and at site and simple insulation system solutions compared to for example European Patent No. 0285895, where plenty of complex insulation barriers have to be manufactured and assembled with great care.

Another property of the solution used in that prior art patent is that the barriers close to the shielding electrode have to be designed to withstand the full DC voltage, since it does not provide a free current path between the shielding electrode at high potential and ground.

The combination according to the invention of the cylindrical barrier 8 and the shielding electrode barrier 7 combined with solid insulation barriers 12 gives the opportunity to handle very high voltages (AC-strength increased by the shielding electrode barrier system and DC-stress handled by cylindrical barrier) while maintaining a rational production process with easy, parallel manufacturing and assembly.

The high voltage insulation system according to the invention is designed for very high voltages, such as AC/DC voltages over 500 kV, preferably 800 kV and up to 1000 kV.

Although favorable, the scope of the invention must not be limited by the embodiments presented but also contain embodiments obvious to a person skilled in the art. For instance the insulation system can be immersed in dielectric fluid with similar properties as transformer oil. Further, the insulation system principle is applicable for all voltage levels. Further, the insulation system could be used for HVAC transformers and reactors, since it inherently possesses the suitable properties for that.

The invention claimed is:

1. A high voltage insulation system for high-voltage direct current, comprising:

a bushing including a conductor, a transformer conductor, a connection between the conductor and the transformer conductor, a conductive shielding electrode shields the connection between the bushing and the transformer conductor, a surrounding insulation system immersed in transformer oil, the surrounding insulation system comprising transformer insulation material and bushing insulation material, a cylindrical solid insulation barrier enclosing the connection between the bushing conductor and transformer conductor, and a plurality of solid insulation barriers arranged radially outwards from the shielding electrode, wherein the solid insulation barriers are fastened to the shielding electrode on an outer side of the shielding electrode, wherein the solid insulation barriers extend in an axial direction outside an axial direction of the shielding electrode and form a distance to the insulation material of the bushing and the transformer insulation material, whereby a moderate voltage drop over the solid insulation barriers is obtained, and wherein oil ducts are arranged between adjacent solid insulation barriers wherein the extent of the solid insulation barriers and cylindrical insulation barrier provides a free path between the shielding electrode at high potential a ground.

2. The high voltage insulation system according to claim 1, wherein the solid insulation barrier is symmetrical.

3. The high voltage insulation system according to claim 1, wherein a number of solid insulation barriers is between 2 and 4.

4. The high voltage insulation system according to claim 3, wherein a distance between adjacent solid insulation barriers is between 2 mm and 30 mm.

5. The high voltage insulation system according to claim 1, wherein a distance to the insulation material of the bushing and the insulation material of the transformer, respectively, is between 30 mm and 200 mm.

6. The high voltage insulation system according to claim 1, wherein the insulation system is designed for AC/DC voltages over 500 kV.

7. A method for manufacture a high voltage insulation system, the method comprising:

manufacturing a transformer with transformer insulation in a first process;

manufacturing a shielding electrode in a second process;

manufacturing a plurality of solid insulation barriers in a third process;

fastening the solid insulation barriers to the shielding electrode on an outer side of the shielding electrode such that the solid insulation barriers extend radially outwards from the shielding electrode and extend in an axial direction outside an axial direction of the shielding electrode, wherein oil ducts are arranged between adjacent solid insulation barriers;

manufacturing a bushing including a conductor in a fourth process;

manufacturing a cylindrical solid insulation barrier; and enclosing a connection between the bushing conductor and transformer conductor with the cylindrical insulation barrier, wherein the extent of the solid insulation barriers and cylindrical insulation barrier provides a free path between the shielding electrode at high potential a ground, and wherein each process is made independently of each other, and wherein the components are assembled on site.

* * * * *